US007398611B1

(12) United States Patent
Boxer et al.

(10) Patent No.: US 7,398,611 B1
(45) Date of Patent: Jul. 15, 2008

(54) PHOTO ALBUM INSERT

(75) Inventors: Tiffany Boxer, Sherman Oaks, CA (US); Sheldon Plutsky, Chatsworth, CA (US)

(73) Assignee: Pioneer Photo Albums, Inc., Chatsworth, CA (US)

( * ) Notice: Subject to any disclaimer, the term of this patent is extended or adjusted under 35 U.S.C. 154(b) by 52 days.

(21) Appl. No.: 10/365,275

(22) Filed: Feb. 11, 2003

Related U.S. Application Data

(63) Continuation-in-part of application No. 10/323,481, filed on Dec. 18, 2002, which is a continuation-in-part of application No. 09/841,169, filed on Apr. 24, 2001, now Pat. No. 6,601,327, which is a continuation of application No. 09/453,355, filed on Dec. 1, 1999, now Pat. No. 6,253,475, which is a continuation of application No. 08/482,171, filed on Jun. 7, 1995, now abandoned, which is a continuation of application No. 08/092,548, filed on Jul. 16, 1993, now abandoned, which is a continuation of application No. 07/555,063, filed on Jul. 18, 1990, now abandoned, which is a continuation-in-part of application No. 06/609,633, filed on May 14, 1984, now Pat. No. 4,965,948.

(51) Int. Cl.
*G09F 19/00* (2006.01)

(52) U.S. Cl. ..... 40/537; 40/405; 281/15.1; 281/31

(58) Field of Classification Search ..... 206/307, 206/307.1, 308.1, 311; 402/79; 40/124.06, 40/775, 776, 537
See application file for complete search history.

(56) References Cited

U.S. PATENT DOCUMENTS

D268,190 S 3/1983 Nast ..... D19/33
4,629,070 A 12/1986 Roberg ..... 206/445
4,850,731 A 7/1989 Youngs ..... 402/79
D312,835 S 12/1990 Holm ..... D19/33
5,301,445 A 4/1994 Hoffmeister ..... 40/537
5,393,158 A 2/1995 Dall'Arancio ..... 402/79
5,396,987 A * 3/1995 Temple et al. ..... 206/309
5,431,449 A 7/1995 Arimoto et al. ..... 281/31
5,462,160 A 10/1995 Youngs ..... 206/312
5,588,527 A 12/1996 Youngs ..... 206/308.1
5,588,528 A 12/1996 Ozeki ..... 206/308.1
5,620,271 A 4/1997 Bergh et al. ..... 402/79

(Continued)

*Primary Examiner*—Mark T. Le
(74) *Attorney, Agent, or Firm*—Jeffer Mangels Butler Marmaro LLP

(57) ABSTRACT

A photo album insert for holding at least one photograph and at least one compact disc. The insert includes at least two sheets of generally planar material, where at least one of the sheets is substantially transparent. Both of the sheets have a top edge, a bottom edge and first and second opposing side edges. The sheets are generally fixed relative to each other. The insert also includes at least a first photograph stop disposed between the transparent sheet top edge and the transparent sheet bottom edge to define at least a first photograph receiving area, and at least a first compact disc stop disposed between the first photograph stop and the transparent sheet bottom edge to define at least a first compact disc receiving area. The first compact disc receiving area overlaps with and at least partially extends below the first photograph receiving area, and the first compact disc receiving area and the first photograph receiving area cooperate to define a first photograph/compact disc pocket.

13 Claims, 8 Drawing Sheets

U.S. PATENT DOCUMENTS

| | | | | |
|---|---|---|---|---|
| 5,713,683 | A | 2/1998 | Bergh et al. | 402/79 |
| 5,882,748 | A | 3/1999 | Tomoda | 428/35.2 |
| D411,402 | S | 6/1999 | Udwin et al. | D6/626 |
| D421,869 | S | 3/2000 | Drew et al. | D6/626 |
| D426,099 | S | 6/2000 | Udwin et al. | D6/626 |
| D428,297 | S | 7/2000 | Drew et al. | D6/626 |
| D431,408 | S | 10/2000 | Drew et al. | D6/626 |
| D432,343 | S | 10/2000 | Drew et al. | D6/626 |
| D434,262 | S | 11/2000 | Bergh et al. | D6/626 |
| 6,186,320 | B1 | 2/2001 | Drew | 206/308.1 |
| 6,186,332 | B1 | 2/2001 | Combs | 206/759 |
| 6,202,839 | B1 | 3/2001 | Petersen et al. | 206/308.1 |
| D441,591 | S | 5/2001 | Drew | D6/626 |
| 6,241,086 | B1 | 6/2001 | Bergh et al. | 206/308.1 |
| 6,241,087 | B1 | 6/2001 | Moorhouse, Sr. | 206/308.1 |
| 6,250,460 | B1 | 6/2001 | Dottel | 206/308.1 |
| 6,267,234 | B1 | 7/2001 | Bergh et al. | 206/308.1 |
| 6,325,207 | B2 | 12/2001 | Drew | 206/308.1 |
| 6,390,714 | B1 | 5/2002 | Bradley et al. | 402/79 |
| 6,547,472 | B2 * | 4/2003 | Jordan | 402/79 |
| 6,557,701 | B1 * | 5/2003 | Chen | 206/308.1 |
| 6,601,327 | B2 * | 8/2003 | Ruebens | 40/537 |
| 6,865,837 | B2 * | 3/2005 | Matteau et al. | 40/776 |
| 2001/0000892 | A1 | 5/2001 | Drew | 206/312 |
| 2001/0032793 | A1 | 10/2001 | Bergh et al. | 206/308.1 |
| 2001/0045041 | A1 * | 11/2001 | Fu | 40/776 |
| 2001/0050238 | A1 | 12/2001 | Senior | 206/308.1 |
| 2002/0084200 | A1 | 7/2002 | Bergh et al. | 206/308.1 |

* cited by examiner

PHOTO ALBUM INSERT

APPLICATION PARENT DATA

This application is a continuation-in-part of Ser. No. 10/323,481, entitled Improved 12×12 Photograph Insert Page, filed Dec. 18, 2002, which is a continuation in part of Ser. No. 09/841,169, filed Apr. 24, 2001, now issued as U.S. Pat. No. 6,601,327 which is a continuation of Ser. No. 09/453,355, filed Dec. 1, 1999, now issued as U.S. Pat. No. 6,253,475 B1, which is a continuation of Ser. No. 08/482,171, filed Jun. 7, 1995, now abandoned which is a continuation of Ser. No. 08/092,548, filed Jul. 16, 1993, now abandoned which is a continuation of Ser. No. 07/555,063, filed Jul. 18, 1990, now abandoned which is a continuation in part of Ser. No. 06/609,633; filed May 14, 1984, now U.S. Pat. No. 4,965,948 all of which are incorporated herein by reference.

FIELD OF THE INVENTION

The present invention concerns devices for the storage and display of photographs, compact discs and the like, and more particularly to photo album inserts for the storage and display of photographs, compact discs and the like.

BACKGROUND OF THE INVENTION

Devices for the storage and display of photographs and the like have taken many forms. One form, commonly referred to as a photograph album, comprises a plurality of bound leaves disposed within an outer cover with photographs or similar objects mounted on the two planar surfaces, or display pages, of each leaf. The leaves within the photograph album are commonly made of either a stiff cardboard material or a flexible transparent plastic. In the latter instance, two sheets of transparent plastic are bound together to form a plurality of pockets into which photographs are inserted.

In recent years compact discs, digital versatile discs, digital video discs, CD-ROMs and other optical discs (hereinafter "CD's" or "compact discs") have become popular for storing digital media. For example, digital images or photographs can be stored on CD's. Some people like to have images stored on CD's for viewing on a computer while others enjoy actual hard copies of photos for mounting in photo albums.

For storing CD's flexible sleeves have become increasingly used by consumers for both protecting the CD's and enabling a user to store a group of CD's in a smaller space.

It is advantageous to store a CD with a picture or a contact sheet of pictures that came from the particular CD.

SUMMARY OF THE PREFERRED EMBODIMENTS

In accordance with the present invention, the inventors have developed a novel and non-obvious product and method for storing optical discs, and preferably in conjunction with a photo album, memory scrapbook, memory book or the like.

In accordance with the present invention, there is provided a photo album insert for holding at least one photograph and at least one compact disc. The insert includes at least two sheets of generally planar material, at least one sheet being substantially transparent, and both sheets having a top edge, a bottom edge and first and second opposing side edges. The sheets are generally fixed relative to each other. The insert also includes at least a first photograph stop disposed between the transparent sheet top edge and the transparent sheet bottom edge to define at least a first photograph receiving area, and at least a first compact disc stop disposed between the first photograph stop and the transparent sheet bottom edge to define at least a first compact disc receiving area. The first compact disc receiving area overlaps with and at least partially extends below the first photograph receiving area, and the first compact disc receiving area and the first photograph receiving area cooperate to define a first photograph/compact disc pocket.

In accordance with another aspect of the present invention there is provided a photo album insert for holding at least one photograph and at least one compact disc. The insert includes three sheets of generally planar material, and first and second photograph/compact disc pockets. Two of the three sheets are substantially transparent and the third sheet is disposed between the transparent sheets. All three sheets have a top edge, a bottom edge and first and second opposing side edges and are generally fixed relative to each other. The first photograph/compact disc pocket is associated with one transparent sheet and the second photograph/compact disc pocket is associated with the other transparent sheet. Each pocket includes at least one photograph stop disposed between the transparent sheet top edge and the transparent sheet bottom edge to define a first photograph receiving area, and a compact disc stop disposed between the photograph stop and the transparent sheet bottom edge to define a first compact disc receiving area. The first compact disc receiving area overlaps with and at least partially extends below the first photograph receiving area.

In accordance with yet another aspect of the present invention there is provided a photo album insert for holding at least one photograph and at least one compact disc that includes three sheets of generally planar material, first and second memo areas, first and second top photograph/compact disc pockets, and first and second bottom photograph/compact disc pockets. Two of the three sheets are substantially transparent and the third sheet is disposed between the transparent sheets. All three sheets have a top edge, a bottom edge and first and second opposing side edges, and are generally fixed relative to each other, The first memo area is associated with one transparent sheet and the second memo area is associated with the other transparent sheet. The first top photograph/compact disc pocket is associated with one transparent sheet and the second top photograph/compact disc pocket is associated with the other transparent sheet. Each top pocket includes first and second photograph stops disposed between the transparent sheet top edge and the associated memo area to define a first photograph receiving area, and an arcuate shaped compact disc stop extending between and below the first and second photograph stops to define a first compact disc receiving area. The first compact disc receiving area overlaps with and at least partially extends below the first photograph receiving area.

The first bottom photograph/compact disc pocket is associated with one transparent sheet and the second bottom photograph/compact disc pocket is associated with the other transparent sheet. Each bottom pocket includes first and second photograph stops disposed between the memo area and the transparent sheet bottom edge to define a second photograph receiving area, and an arcuate shaped compact disc stop extending between and below the first and second photograph stops to define a second compact disc receiving area. The second compact disc receiving area overlaps with and at least partially extends below the second photograph receiving area. The first memo area is disposed between the first top photograph/compact disc pocket and the first bottom photograph/compact disc pocket and the second memo area is disposed between the second top photograph/compact disc pocket and the second bottom photograph/compact disc pocket.

In accordance with yet another aspect of the present invention there is provided an album for storage of photographs and compact discs that includes a cover, and at least one photo album insert for holding at least one photograph and at least one compact disc.

In accordance with a further aspect of the present invention there is provided a method of storing compact discs and photographs. The method includes the steps of providing a compact disc, providing a photograph, providing a photograph album insert having at least one photograph/compact disc pocket, inserting the compact disc into the photograph/compact disc pocket, and inserting the photograph into the photograph/compact disc pocket. The compact disc is preferably oriented such that at least a portion of the compact disc is disposed below the photograph in the photograph/compact disc pocket, and the photograph is preferably oriented such that at least a portion of the photograph overlaps the compact disc within the photograph/compact disc pocket. It should be understood that the steps in the method can be performed in a different order than recited above. For example, the photograph can be inserted into the pocket before the compact disc.

In a preferred embodiment of the invention, the compact disc rests on a compact disc stop when inserted into the photograph/compact disc pocket and the photograph rests on a photograph stop when inserted into the photograph/compact disc pocket.

In accordance with another aspect of the present invention there is provided a method of manufacturing a photo album insert. The method includes the steps of providing a first sheet having a front, a back and a plurality of spot weld holes defined therein, providing a pair of transparent sheets, and spot welding the pair of transparent sheets to one another through the spot weld holes in the first sheet, thereby forming a series of spot welds. The first sheet and the transparent sheets are fixed relative to one another. At least a portion of the series of spot welds define a first photograph/compact disc receiving pocket on the front of the first sheet and a first photograph/compact disc receiving pocket on the back of the first sheet, and at least a portion of the series of spot welds form a photo stop and a compact disc stop in the first photograph/compact disc receiving pocket on the front of the first sheet and a photo stop and a compact disc stop in the first photograph/compact disc receiving pocket on the back of the first sheet.

In a preferred embodiment, at least a portion of the series of spot welds define a second photograph/compact disc receiving pocket on the front of the first sheet and a second photograph/compact disc receiving pocket on the back of the first sheet, and at least a portion of the series of spot welds form a photo stop and a compact disc stop in the second photograph/compact disc receiving pocket on the front of the first sheet and a photo stop and a compact disc stop in the second photograph/compact disc receiving pocket on the back of the first sheet.

In accordance with yet another aspect of the present invention there is provided a photo album insert including first and second sets of laterally adjacent binding apertures. The first set of binding apertures is disposed on one side of a fold line and the second set is disposed on the opposite side of the fold line. When the insert is folded along the fold line the first and second sets of binding apertures at least partially overlap.

In accordance with a further aspect of the present invention there is provided a method of inserting a photo album insert into a photo album. The method includes the steps of providing a photo album having at least one binder, providing a photo album insert having at least first and second sets of binding apertures and a fold line, folding the insert along the fold line, overlapping at least one of the binding apertures in the first set of binding apertures and at least one of the binding apertures in the second set of binding apertures, and inserting the photo album binder through the overlapped binding apertures, thereby securing the photo album insert in the photo album.

In accordance with another aspect of the present invention there is provided a device for associating an insert with a binder. The device includes first and second spine areas that are disposed on opposite sides of a fold line. Each spine area has a set of at least two binding apertures defined therein.

DETAILED DESCRIPTION OF THE PREFERRED EMBODIMENTS

Figure 1:
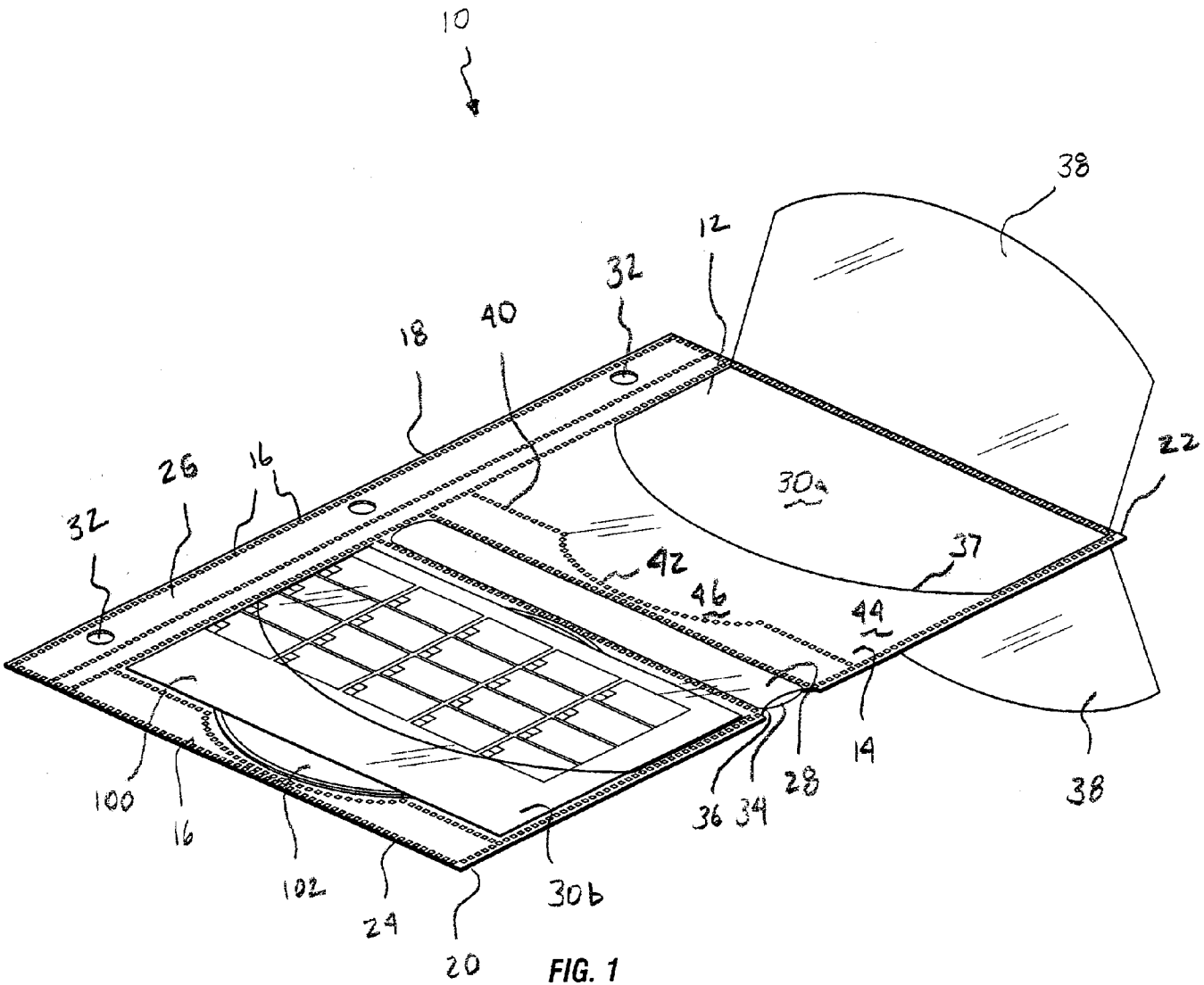
FIG. 1 is a perspective view of a preferred embodiment of the photo album insert showing the flaps open and a CD and index sheet in one of the photo/CD pockets.

The present invention is preferably directed to a double-sided, four pocket page or sleeve constructed with a single sheet of non-woven material sandwiched between two clear plastic sheets. The page is intended to be inserted into a photo album. Accordingly, the page is referred to herein as a photo album insert. Each pocket is preferably designed to hold a photo CD or compact disc (i.e., an optical disc containing digital images) and a corresponding preview ("thumbnail") index print (or a single photograph) of the digital images contained on the photo CD. The index print and photo CD can be supported by a series of spot welds between two plastic sheets, and the index print is preferably displayed in front of the photo CD in the pocket, although the index print may also be placed behind the photo CD. In addition, a slot (referred to herein as a memo area) is disposed between the top and bottom pockets of each side of the sheet to insert a label (referred to herein as a memo insert) to identify the title of each photo CD or to include other information.

It will be understood that photo, photograph and index print are used interchangeable herein.

Referring now to the drawings, and more particularly to FIGS. 1–4 thereof, there is shown a preferred embodiment of a photo album insert, generally designated 10, of the present invention. In a preferred embodiment, the photo album insert 10 includes a generally planar first sheet 12 sandwiched between two substantially transparent sheets 14. In describing the photo album insert 10 only one side of the double-sided insert 10 will be described. It will be understood that both sides of the photo album insert 10 are similar. In another preferred embodiment the insert 10 only includes a single transparent sheet 14 (i.e., the insert is one-sided). The transparent sheet 14 is made of a clear plastic as is typical in the art. The first sheet 12 can be made of a flexible cardboard or a plastic, such as woven or non-woven polypropylene, polyethylene or polyester.

The insert 10 includes first and second side edges 18, 20 and top and bottom edges 22, 24. The first and second sides edges and top and bottom edges of the first sheet 12 are designated herein as 18*a*, 20*a*, 22*a*, and 24*a*. The first and second sides edges and top and bottom edges of the transparent sheets 14 are designated herein as 18*b*, 20*b*, 22*b*, and 24*b*.

Figure 3:
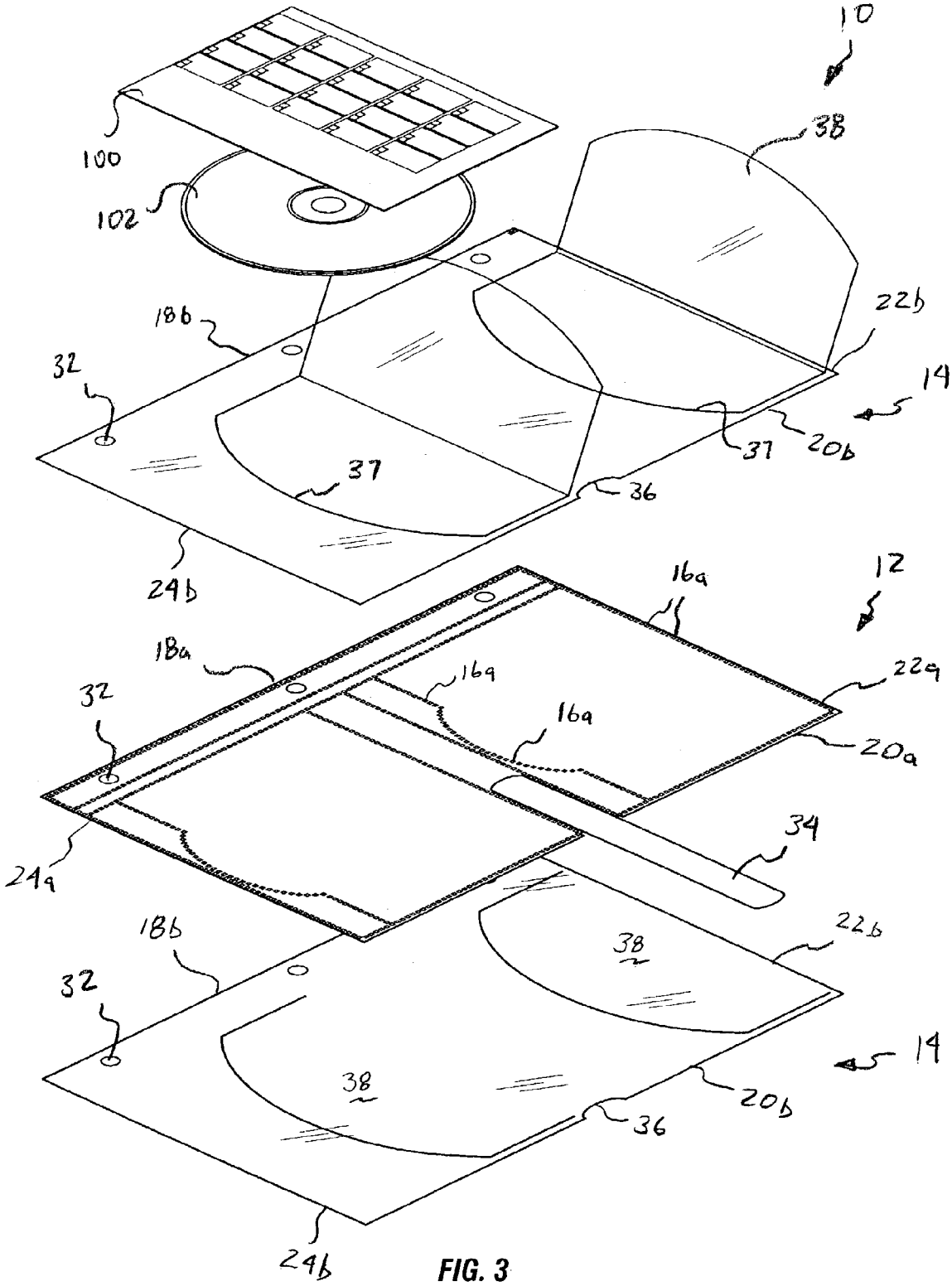
FIG. 3 is an exploded perspective of the photo album insert before the two transparent sheets have been spot welded to one another.
Figure 4:
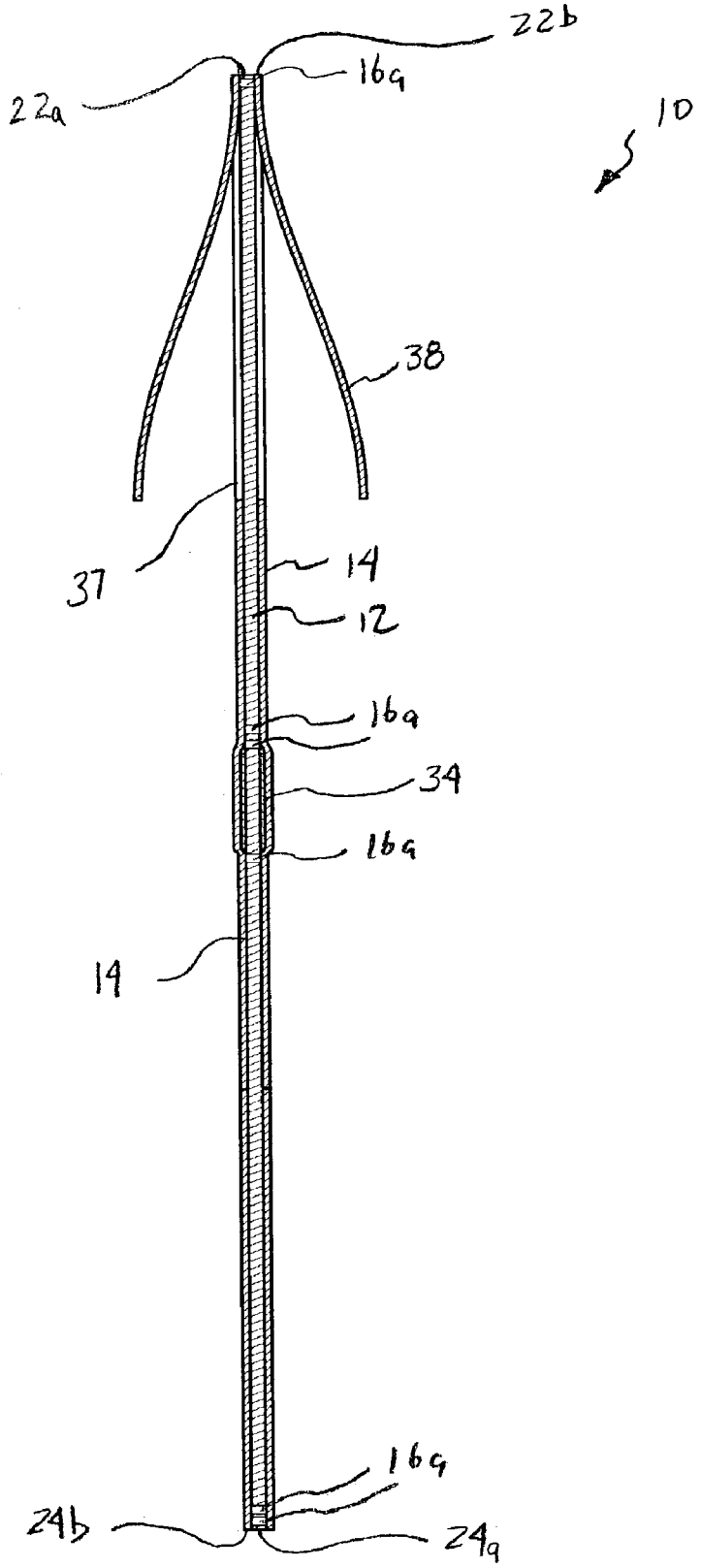
FIG. 4 is a cross-sectional view of an album insert of a preferred embodiment of the present invention with the CD and photo removed and taken along line 4—4 of FIG. 2.

The transparent sheet 14 and the first sheet 12 are generally fixed relative to one another. In a preferred embodiment, the first sheet 12 and transparent sheets 14 are fixed relative to one another using a series of spot welds 16. The first sheet 12 contains a series of spot weld openings 16*a* therein, as best shown in FIG. 3. To fix the sheets 12, 14 relative to one another, the two transparent sheets 14 are spot welded or otherwise bonded to one another through the spot weld openings 16*a*. In FIG. 3, the transparent sheets 14 are shown exploded from the first sheet 12 before spot welding. It will be appreciated by those skilled in the art that other methods for binding the transparent sheets 14 to the first sheet 12 can be used. For example, the transparent sheets 14 can be glued or otherwise adhered to the first sheet 12. In such a case the spot weld openings 16*a* may be omitted. Accordingly, the term spot weld 16 is used herein to refer to an area of the insert where the transparent sheet 14 and first sheet 12 are fixed relative to one another such that an object, such as a photograph, cannot fit between the two sheets 12, 14.

In another embodiment, the spot weld opening 16*a* may be a single long opening through which the transparent sheets 14 are attached to one another, instead of a series of small openings.

As shown in FIG. 1, a series of spot welds 16 run along the first and second side edges 18, 20 and top and bottom edges 22, 24. In a preferred embodiment, the spot welds 16 also cooperate to form a spine area 26, a memo area 28, and first and second photo/CD pockets 30*a*, 30*b*.

Figure 7:
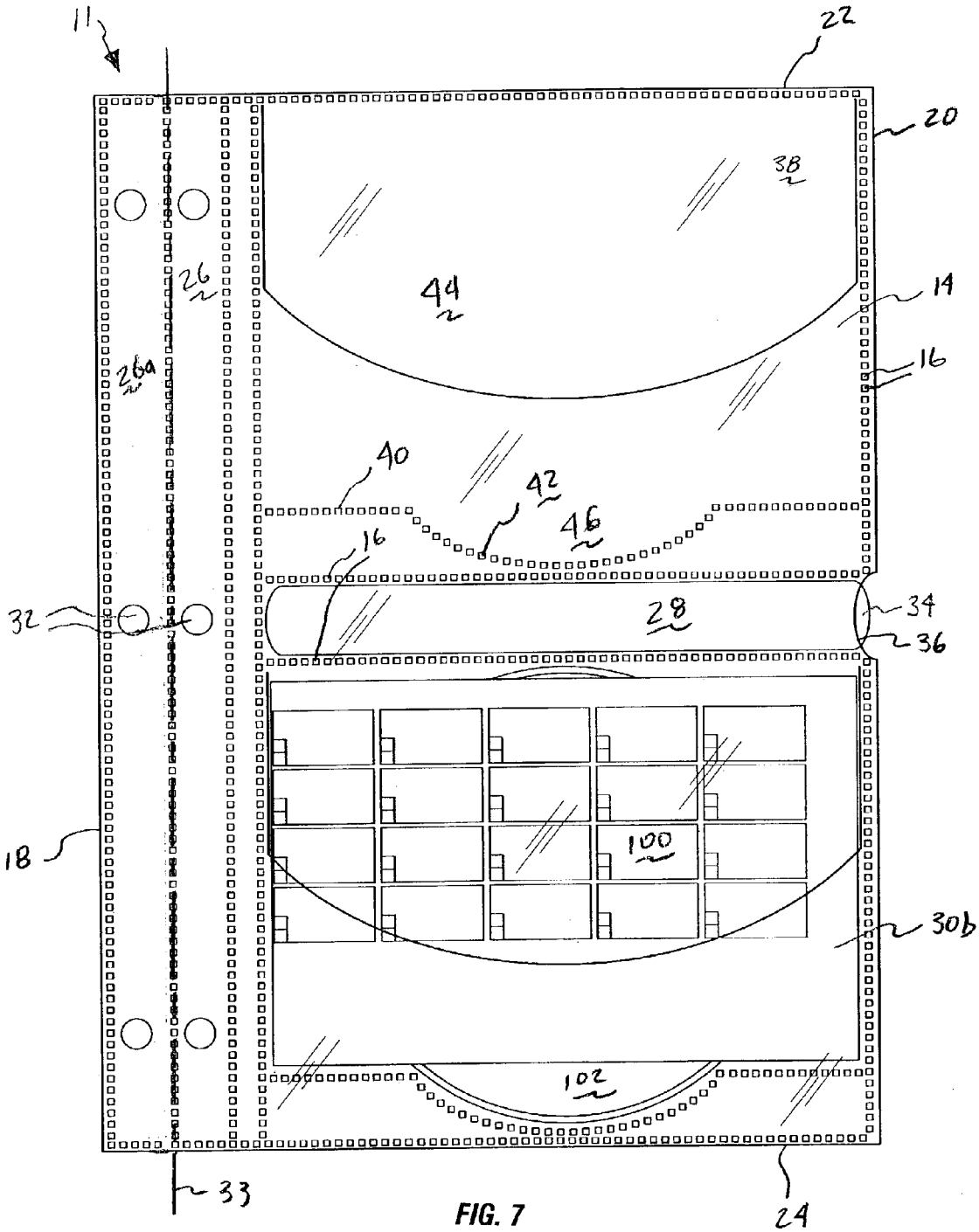
FIG. 7 is a front elevational view of a photo album insert in accordance with another preferred embodiment of the present invention, wherein the insert includes two spine areas.

The spine area 26 is the area of the insert 10 that is generally bound in a photo album. In a preferred embodiment, the spine area 26 includes binding apertures 32 defined therein. The binding apertures 32 receive rings or posts as are typical in three ring binder or post-type photo albums. As shown in FIG. 7, in another preferred embodiment, the insert 11 includes a second spine area 26*a*. With two spine areas 26, 26*a* there are two sets of binding apertures 32 defined in the insert 11. The two sets of binding apertures 32 are laterally adjacent to one another such that the insert 11 can be folded along a fold line 33 to make the binding apertures 32 of the two sets overlap. In use, the second spine area 26*a* is folded over the first spine area 26 along a series of spot welds 16 (considered the fold line 33 in this embodiment) such that the spine areas 26, 26*a* and the binding apertures 32 in each overlap. The insert 10 is then placed in a photo album (by placing the apertures 32 over the rings or posts of the album). The overlapped spine areas 26 provide increased strength. Inserts tend to pull out of photo albums by tearing at the binding apertures.

In another embodiment the sets of binding apertures 32 may not be laterally adjacent to one another. They may include another spine area 26 or other strip therebetween.

In one preferred embodiment of the insert 11, the insert 11 has the same width as insert 10. Those skilled in the art will appreciate that photo album inserts or pages have a number of typical widths, depending on the type of album(s) to which they are intended to be inserted. This way, if the photo album insert 11 is placed into a photo album using the outermost set of binding apertures 32, the second side edge 20 will be flush with any prior art photo album inserts. It will be understood that if the two spine areas 26 are folded over on one another, the second side edge 20 will not be flush with any prior art photo album inserts in the album. The width of the insert 11 will actually be shorter than the other inserts.

Figure 2:
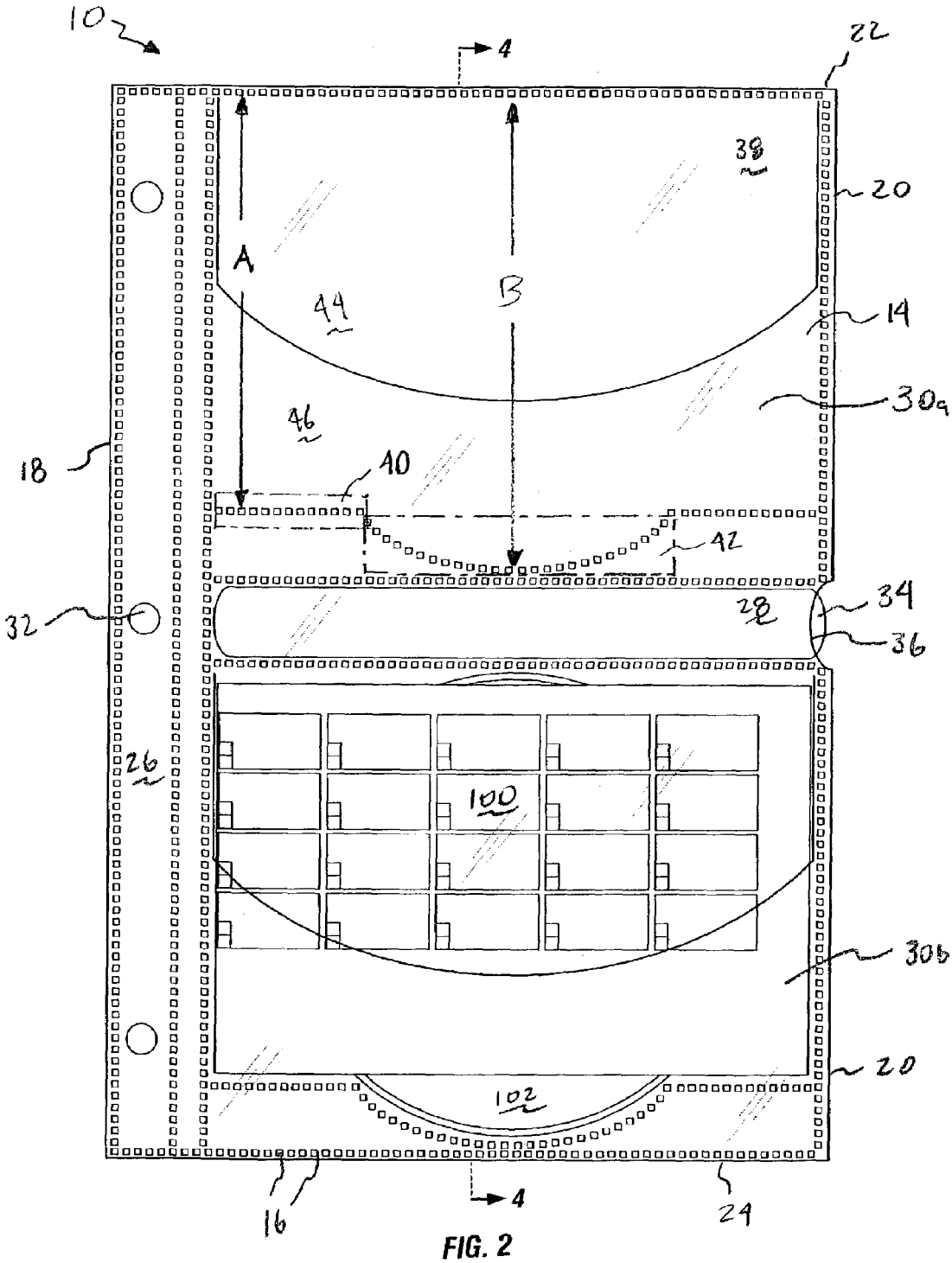
FIG. 2 is a front elevational view of the photo album insert of FIG. 1.

The memo area 28 is provided so that a memo insert 34 can be inserted therein. The memo insert 34 is used for the recordation of pertinent information. For example, the memo insert may include photo captions or information relating to what number the photo is on the accompanying CD. Preferably, there is an area of the second side edge 20 where the first sheet 12 and transparent sheets 14 are not spot welded or otherwise attached to one another, thus forming a memo opening 36 between the transparent sheet 14 and the first sheet 12. The memo insert 34 is received through the memo opening 36 and is slid between the sheets 12, 14 and into place in the memo area 28, as shown in FIG. 2. In a preferred embodiment, the memo area 28 is disposed between the photo/CD pockets 30*a*, 30*b*. However, the memo area 28 can be disposed at the top or bottom or along one of the side edges of the insert 10 as well.

The photo/CD pockets 30*a*, 30*b* are configured to receive at least one photograph 100 and at least one CD 102 therein. In a preferred embodiment, a portion of the transparent sheet 14 over the photo/CD pockets 30*a*, 30*b* is cut to form a photo/CD receiving opening 37 and a flap 38. The opening 37 is sized so as to be capable of receiving photos 100 and CD's 102. For example, many photos 100 and index sheets 100 are sized at 4"×6", and the typical CD 102 has a diameter of approximately $4\frac{11}{16}$". In use, the flap 38 is lifted up by a user and a photo or CD can then be inserted through opening 37 and into the photo/CD pocket 30*a* or 30*b*.

In another preferred embodiment, the flap 38 can be omitted. In this embodiment, the transparent sheet 14 can have an opening 37 cut therein for insertion of the photo or CD, or the transparent sheet 14 can simply have a slit cut therein.

The photo/CD pockets 30*a*, 30*b* each include at least one photo stop 40 and at least one CD stop 42. In FIG. 2, the photo stop 40 and CD stop 42 are highlighted by a box formed by phantom lines. As is illustrated in FIG. 2, preferably, the photo and CD stops 40, 42 are formed by a series of spot welds 16 and the CD stop 42 is at least partially spaced below the photo stop 40. A photo receiving area 44 is defined between the photo stop 40 and the series of spot welds 16 that define the top of the photo/CD pocket 30*a* or 30*b*. For example, in photo/CD pocket 30*a*, the photo receiving area 44 is defined between the photo stop 40 and the series of spot welds 16 adjacent the top edge 22 of the insert (depicted as "A" in FIG. 2).

A CD receiving area 46 is defined between the CD stop 42 and the series of spot welds 16 that define the top of the photo/CD pocket 30*a* or 30*b*. For example, in photo/CD pocket 30*a*, the CD receiving area 46 is defined between the CD stop 12 and the series of spot welds 16 adjacent the top edge 22 of the insert (depicted as "B" in FIG. 2). As a result of the CD stop 42 being spaced below the photo stop(s) 40, at least a portion of the CD receiving area 46 extends below the photo receiving area 44. The rest of the CD receiving area 46 overlaps or is concurrent with the photo receiving area 44.

Figure 5:
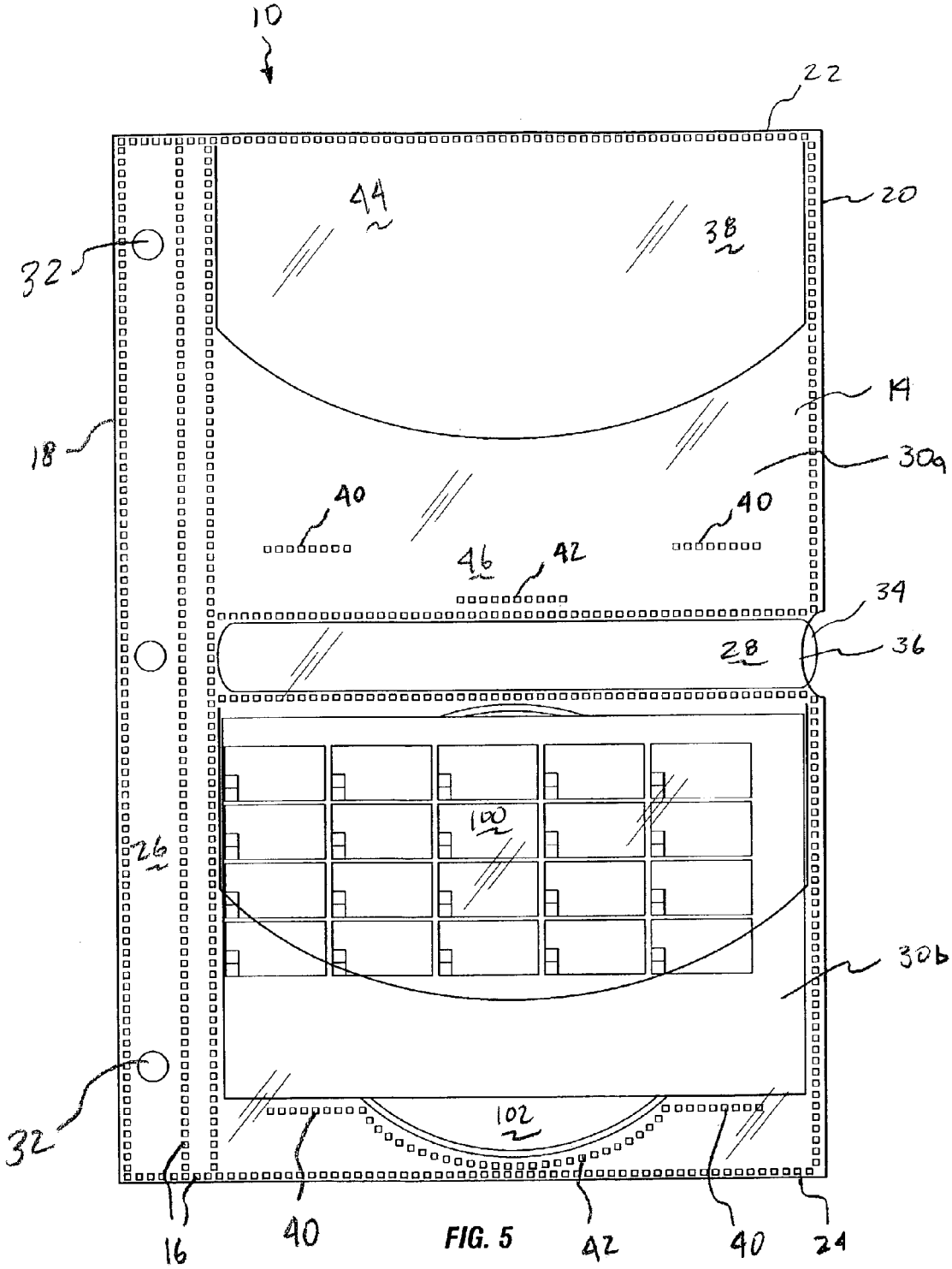
FIG. 5 is a front elevational view of another preferred embodiment of the present invention.
Figure 8:
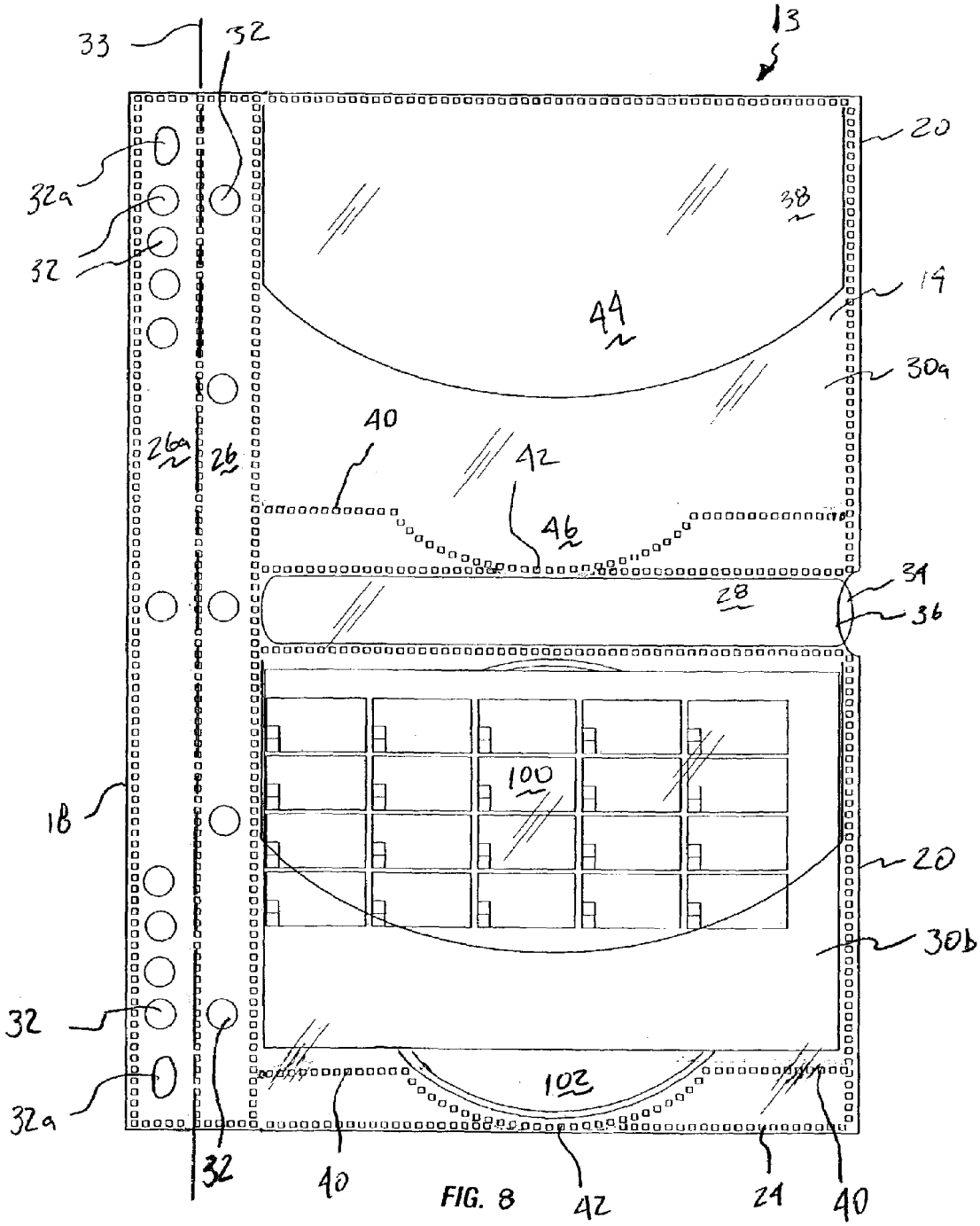
FIG. 8 is a front elevational view of a photo album insert in accordance with yet another preferred embodiment of the present invention, wherein the insert includes multiple binding apertures.

In a preferred embodiment, the photo/CD pockets 30*a*, 30*b* include two spaced apart photo stops 40, the first extending laterally from adjacent the spine area 26 and the second extending laterally from adjacent the second side edge 20. Preferably, the CD stop 42 is arcuate in shape and extends between the photo stops 40. In another embodiment the CD stop 42 can be linear in shape, as shown in FIG. 5. The photo stops 40 are spaced apart far enough from each other to allow a CD to rest on the CD stop 42. In still another embodiment, as shown in FIG. 8, the CD stop 42 can be partially co-linear with the series of spot welds 16 defining the memo area 28 or the series of spot welds 16 defining the top of the bottom pocket 30*b* or the series of spot welds 16 at the bottom edge 16. In still another embodiment, the arcuate portion of the CD stop can be omitted and the series of spot welds 16 defining the memo area 28 or the series of spot welds 16 defining the top of the bottom pocket 30*b* or the series of spot welds 16 at the bottom edge 16 can act as the CD stop.

As will be appreciated, the spirit of the invention lies in the fact that the length, orientation, and location of the photo and CD stops 40, 42 permit secure storage of a photograph, CD or both within the same pocket 30*a*, 30*b*. It will be understood that photographs, index sheets or CD's can be mixed and matched within different pockets. For example, a single photo can be placed in the top pocket 30*a* and a plurality of CD's can be placed in the bottom pocket 30*b*.

Figure 6:
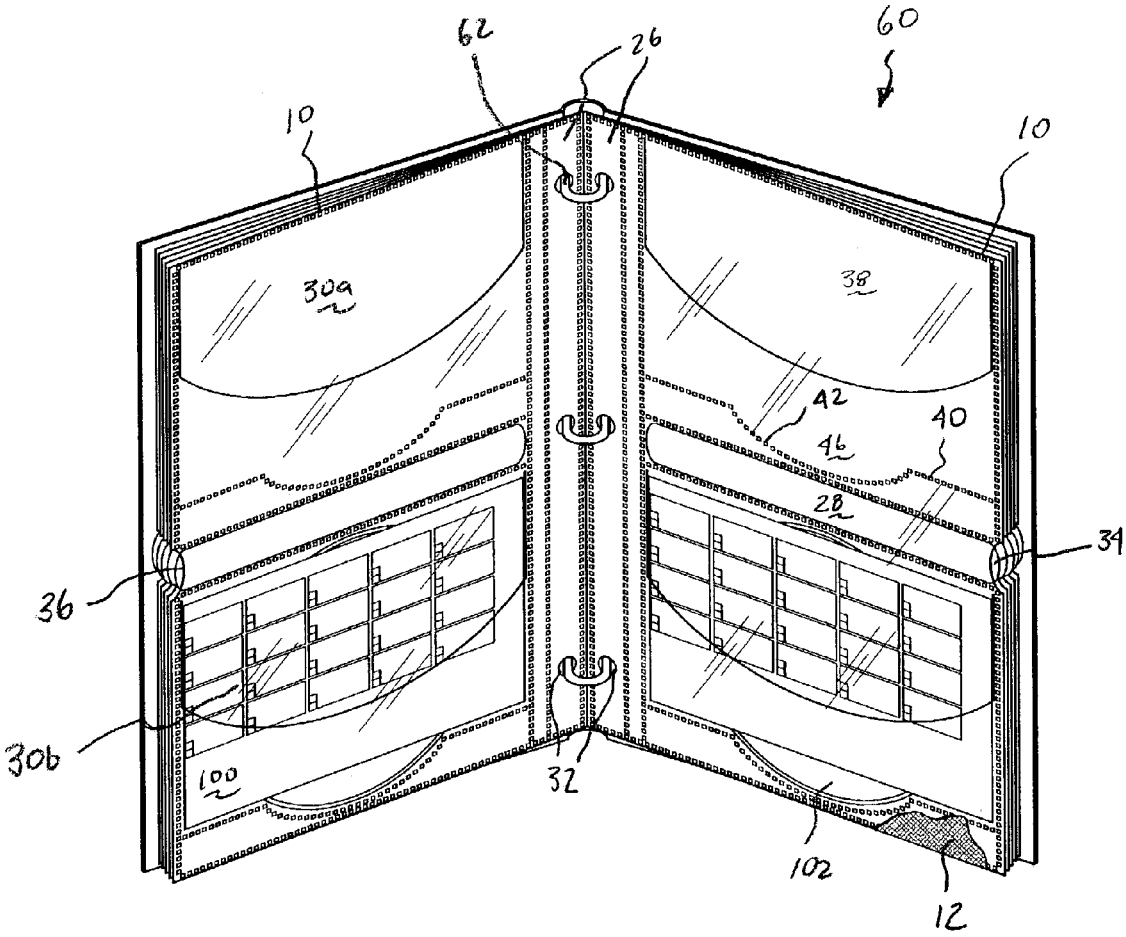
FIG. 6 is a perspective view of a photo album including a plurality of photo album inserts.

As shown in FIG. 6, a plurality of inserts 10 can be inserted into an album 60 for the storage of a plurality of photo CD's, photos and index sheets. The photo album 60 includes binders 62 for receiving the inserts. It will be understood that there are many types of photo album binders, including posts, straps, ribbons, loops and the like. Binder is used herein as a general term to cover all known types of photo album/memory scrapbook binders.

In another embodiment of the invention, the insert 10 can include orientation ribs as disclosed in parent U.S. Pat. No. 6,253,475 B1, which is incorporated by reference in its entirety herein. The orientation ribs can be formed using a series of spot welds 16 or by other means of adhering the transparent sheet 14 to the first sheet 12. The orientation ribs allow photos or index sheets to be placed in the insert in either a vertical or horizontal orientation (bi-directional).

It should be understood that any number of photo or CD stops, or photo or CD receiving areas or orientation ribs may be included, depending on the number and size of photographs or CD's and the like to be stored in the insert 10, without departing from the spirit of the invention. Similarly, the length of the photo and CD stops or the orientation ribs will vary depending on the maximum size of photographs or CD's intended for storage in the photo album insert 10.

Numerous alterations could be introduced without departing from the spirit of the invention. For example, the binding apertures 32 can be omitted. Various types of other binders or binding means could be employed, for example, engaging the inserts 10 in a greater or lesser number of locations. A binding means permitting the insertion and removal of album leaves 12 from the album could also be employed. A greater number of orientation ribs could be included and disposed substantially as disclosed above for storage of a greater number of photographs.

As discussed herein, a variety of binding means may be used with inserts 10. In a preferred embodiment, a plurality of slots and a plurality of holes are located on each insert 10. Each slot and hole combination, together generally referred to as a keyhole, allows the album leaves to be used in a variety of binders. The keyhole, along with other embodiments of the hole and slot combination that is functionally equivalent, is further described in U.S. Pat. No. 6,027,140, entitled PHOTOGRAPH ALBUM PAGE INSERT, commonly owned by the Assignee of the present invention, the entire disclosure of which is expressly incorporated herein by reference. It will be understood that the term binding aperture is not intended to be limiting, and is used herein to refer to circular apertures, non-circular apertures, keyhole shaped apertures, and slots, etc.

As shown in FIG. 8, in another preferred embodiment of the invention, an insert 13 can include more than three binding apertures 32 in the spine area 26 or 26*a* and/or can include non-circular circular binding apertures 32*a*. Any combination of binding apertures 32, 32*a* is within the scope of the present invention. This allows the insert 10, 11 or 13 to be more universally usable in different types and sizes of photo albums. It will be appreciated that when insert 13 is folded along fold line 33 the two sets of binding apertures 32, 32*a* on spine areas 26 and 26*a* at least partially overlap.

From the foregoing, it is believed that the invention may be readily understood by those skilled in the art without further description. As discussed above, numerous changes may be made in the details disclosed without departing from the spirit of the invention, as set forth in the claims below.

What is claimed is:

1. A photo album insert for holding at least one photograph and at least one compact disc, said photo album insert comprising:

at least two sheets of generally planar material, at least one sheet being substantially transparent, both sheets having a top edge, a bottom edge and first and second opposing side edges, the sheets being generally fixed relative to each other, first and second spaced apart photograph stops disposed between the transparent sheet top edge and the transparent sheet bottom edge to define at least a first photograph receiving area, wherein the first and second photograph stops extend in a lateral direction, are oriented such that they are substantially parallel to the transparent sheet top edge, and have a length and a height, wherein the length is greater than the height, at least a first compact disc stop having an arcuate shape that is disposed between the first and second photograph stops and the transparent sheet bottom edge to define at least a first compact disc receiving area, wherein said first compact disc receiving area overlaps with and at least partially extends below said first photograph receiving area, and wherein said first compact disc receiving area and said first photograph receiving area cooperate to define a first photograph/compact disc pocket.

2. The photo album insert of claim 1 further comprising third and fourth photograph stops disposed between the first compact disc stop and the transparent sheet bottom edge to define a second photograph receiving area, wherein the third and fourth photograph stops extend in a lateral direction and have a length and a height, wherein the length is greater than the height, and a second compact disc stop disposed between the second photograph stop and the transparent sheet bottom edge to define a second compact disc receiving area, wherein said second compact disc receiving area overlaps with and at least partially extends below said second photograph receiving area, and wherein said second compact disc receiving area and said second photograph receiving area cooperate to define a second photograph/compact disc pocket.

3. The photo album insert of claim 2 further comprising a memo area.

4. The photo album insert of claim 3 wherein said memo area is disposed between said first and second photograph/compact disc pockets.

5. The photo album insert of claim 4 further comprising a memo opening between said transparent sheet and said first sheet.

6. The photo album insert of claim 5 further comprising a memo insert, wherein said memo insert is inserted into said memo opening and is disposed in said memo area.

7. The photo album insert of claim 1 further comprising a plurality of binding apertures.

8. The photo album insert of claim 1 wherein said compact disc stop is disposed between said first and second photo stops in a transverse direction, and wherein said compact disc stop is located between said first and second photo stops and said bottom edge of said transparent sheet in a longitudinal direction.

9. A photo album insert for holding at least one photograph and at least one compact disc, said photo album insert comprising:

a) three sheets of generally planar material, two of said sheets being substantially transparent and said third sheet being disposed between said transparent sheets, wherein all three sheets have a top edge, a bottom edge and first and second opposing side edges, the sheets being generally fixed relative to each other, b) first and second photograph/compact disc pockets, said first photograph/compact disc pocket being associated with one transparent sheet and said second photograph/compact disc pocket being associated with the other transparent sheet, each pocket including:

i) first and second photograph stops disposed between the transparent sheet top edge and the transparent sheet bottom edge to define a first photograph receiving area having first and second opposing sides, wherein the first and second photograph stops extend in lateral directions from respective opposing sides of the first photograph receiving area and have a length and a height, wherein the length is greater than the height, and ii) a compact disc stop having an arcuate shape that is disposed between said first and second photograph stops and said transparent sheet bottom edge to define a first compact disc receiving area, wherein said first compact disc receiving area overlaps with and at least partially extends below said first photograph receiving area.

10. The photo album insert of claim 9 further comprising first and second memo areas.

11. The photo album insert of claim 10 further comprising first and second memo openings, said first memo area defined between one transparent sheet and said third sheet, and said second memo area defined between the other transparent sheet and said third sheet.

12. The photo album insert of claim 11 further comprising first and second memo inserts, wherein said memo inserts are inserted into said first and second memo openings and are disposed in said first and second memo areas, respectively.

13. An album for storage of photographs and compact discs, the album comprising:

a) a cover, and b) at least one photo album insert for holding at least one photograph and at least one compact disc, said photo album insert including:

at least two sheets of generally planar material, at least one sheet being substantially transparent, both sheets having a top edge, a bottom edge and first and second opposing side edges, the sheets being generally fixed relative to each other, first and second spaced apart photograph stops disposed between the transparent sheet top edge and the transparent sheet bottom edge to define at least a first photograph receiving area, wherein the first and second photograph stops extend in a lateral direction and have a length and a height, wherein the length is greater than the height, and wherein the length is substantially parallel with the top edge of the two sheets, at least a first compact disc stop having an arcuate shape that is disposed between the first and second photograph stops and the transparent sheet bottom edge to define at least a first compact disc receiving area, wherein said first compact disc receiving area overlaps with and at least partially extends below said first photograph receiving area, and wherein said first compact disc receiving area and said first photograph receiving area cooperate to define a first photograph/compact disc pocket.

* * * * *